United States Patent [19]

Tanasawa et al.

[11] 4,192,466

[45] Mar. 11, 1980

[54] SWIRL INJECTION VALVE

[75] Inventors: Yasusi Tanasawa, Nagoya; Norio Muto, Aichi; Akinori Saito, Nagoya, all of Japan

[73] Assignee: Kabushiki Kaisha Toyota Chuo Kenkyusho, Nagoya, Japan

[21] Appl. No.: 879,457

[22] Filed: Feb. 21, 1978

[30] Foreign Application Priority Data

Feb. 21, 1977 [JP] Japan ..... 52-18401

[51] Int. Cl.[2] ..... B05B 1/30

[52] U.S. Cl. ..... 239/464; 239/533.3; 239/533.12

[58] Field of Search ..... 239/464, 463, 468, 471, 239/472, 491, 492, 493, 533.1, 533.12, 533.3

[56] References Cited

U.S. PATENT DOCUMENTS 3,830,433 8/1974 Miyake ..... 239/533.12

4,120,456 10/1978 Kimura et al. ..... 239/464

FOREIGN PATENT DOCUMENTS 446325 4/1936 United Kingdom ..... 239/533.3

*Primary Examiner*—James B. Marbert

*Attorney, Agent, or Firm*—Berman, Aisenberg & Platt

[57] ABSTRACT

A swirl injection valve for injecting pressurized fluid, such as fuel, into an engine or the like through passages connecting a fuel source to an injection port and forming a swirl flow in the fluid prior to injection by introducing the fluid tangentially into a swirl chamber located adjacent the port.

23 Claims, 34 Drawing Figures mm
0
5
10
15
20

0
5
10
15
20
25
0
10
20
30
40
50

SWIRL INJECTION VALVE

SUMMARY OF THE INVENTION

This invention relates to a swirl injection valve useful as a liquid particle generator, for example, as an injection valve for various combustion apparatus or as a fuel injection valve for diversified types of thermal engines.

Various types of fuel injection valves have been used widely in diesel and gasoline engines. However, the conventional fuel injection valves invariably have inferior atomization characteristics due to drawbacks in their construction or accuracy, are greatly influenced by the injection pressure, and have low response of fuel injection to the injection pressure. In addition, the conventional injection valves practically have problems in that they have complicated construction which involve various troubles and require high precision, thereby making the manufacturing, machining and assembling processes extremely difficult. Due to faulty fuel supply, it has been difficult to effect complete combustion in the above-mentioned engines, resulting in production of toxic gases such as hydrocarbons HC and carbon monoxide CO in the exhaust gases to cause air pollution, producing troubles to the engine operation to lower the efficiency of various operations, and inviting uneconomical fuel consumption.

In an attempt to eliminate the above-mentioned drawbacks and difficulties, the present inventors have conducted numerous experiments and analyses on various types of swirl injection valves to study their atomization characteristics, namely, the particle conditions of the sprayed liquid (including numerical particle distribution, particle size distribution, surface area distribution, weight and volume distribution, and means diameter of distributed particles) and to investigate the possibility of obtaining a swirl injection valve with excellent atomization characteristics. As a result, the present inventors succeeded in developing a swirl injection valve which, even at low injection pressure, can inject a liquid in atomized particles which have been conventionally difficult to produce, with a high response to the injection pressure by making the diameter and height of a swirl chamber of injection valve extremely small, contrary to the common technical knowledge. Reference is made to Japanese Patent No. 815112. This swirl injection valve has been and is widely used in various fields of industry, particularly as a fuel injection valve for combustion apparatus in general and for the combustors for gas turbines. This valve shows excellent atomization characteristics and high response to the injection pressure to ensure practically satisfactory high performance and efficiency when it is used in the combustion apparatus where the fuel is injected constantly without variations in relation with time.

However, the above-mentioned swirl injection valve has problems when applied to reciprocating gasoline or diesel engines where the fuel is supplied at an inconstant flow rate varying with time or the fuel is injected intermittently. More particularly, the swirl injection valve of our prior invention is equipped with a valve device which communicates with the swirl chamber and continuously performs the opening and closing operations of an injection valve at an extremely high speed. However, such a valve device has problems inherent in its construction or in the precision needed in machining and assembling. Coupled with such technical limitations are the unsatisfactory or in some cases deteriorated atomization characteristics and response to the injection pressure, which invite various difficulties such as directional instability of the injected fuel and the like. Therefore, the above-mentioned injection valve causes inconvenience of engine operations such as misfiring due to incomplete combustion of the fuel caused by faulty fuel supply, production of toxic gases, and uneconomical consumption of the fuel.

The present invention forms a strong and fast swirl flow within the swirl chamber by tangentially supplying the pressurized fluid having no velocity component of an axial direction into the swirl chamber, so that the atomization characteristics and response to the injection pressure are improved. Further, by this invention there is provided a practically useful swirl injection valve which has improved and simplified construction to allow facilitated manufacturing, machining and assembling suitable for mass production, which is excellent in durability and easy to handle, and which has optimum atomization characteristics and quick response of the atomization to the injection pressure.

It is one object of the present invention to provide a novel and practically useful swirl injection valve which is excellent in durability and easy to handle.

It is another object of the present invention to provide a swirl injection valve which forms a strong and fast swirl flow within the swirl chamber by tangentially supplying the pressurized fluid having no velocity component of the axial direction therein.

It is still another object of the present invention to provide a swirl injection valve which even at a low injection pressure injects a fuel with excellent atomization characteristics and high response to the injection pressure without dribbling, forming of coarse particles of fuel, or other defects and drawbacks of the conventional valves.

It is still another object of the present invention to provide a swirl injection valve used as a fuel injection valve for combustion apparatus or thermal engines, by which generation of toxic gases causing air pollution is prevented, and the stabilized and smoothened operation of apparatus or engines is achieved efficiently at a low fuel cost.

It is still another object of the present invention to provide a swirl injection valve having an improved and simplified construction to allow facilitated manufacturing, machining and assembling suitable for mass production.

In the figures: 1 ... denotes a nozzle body; 2 ... an injection port; 3 ... a valve seat; 4 ... a nozzle member; 5 ... a needle valve guide bore; 6 ... a needle valve; 8 ... a swirl chamber; 40 ... a tangential pressurized fuel supply passage; 9 ... a valve device.

DETAILED DESCRIPTION OF THE INVENTION

Hereafter, the construction, operation and effects of the swirl injection valve according to the present invention are described in detail by way of preferred embodiments.

Figure 1:
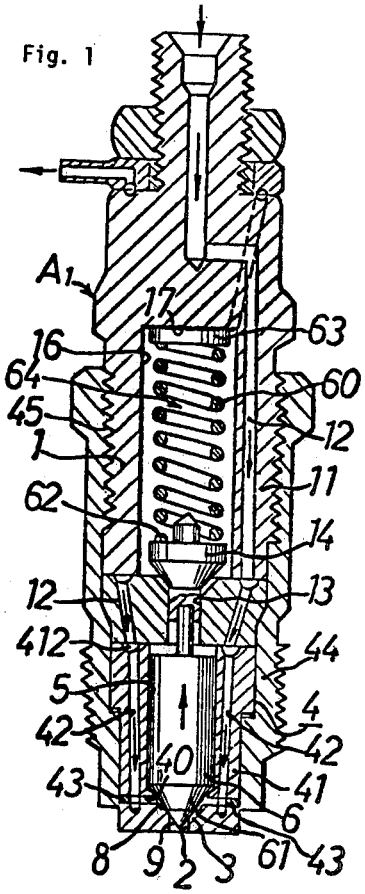
FIG. 1 is a longitudinal sectional view showing a swirl injection valve constituting the first embodiment of the invention.
Figure 2:
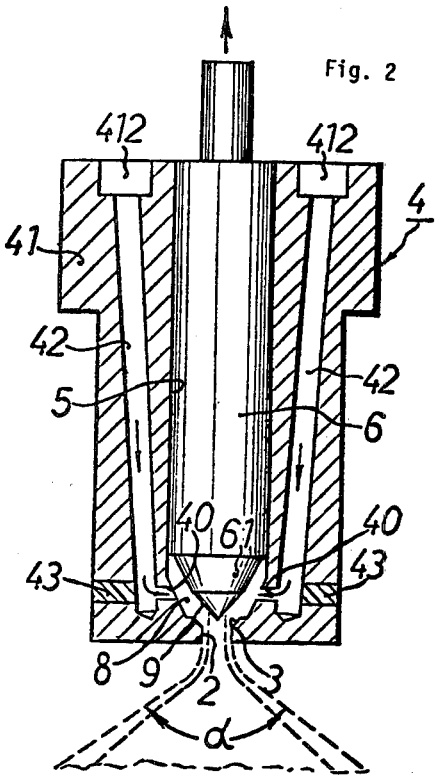
FIG. 2 is an enlarged sectional view of the nozzle member of FIG. 1.
Figure 3:
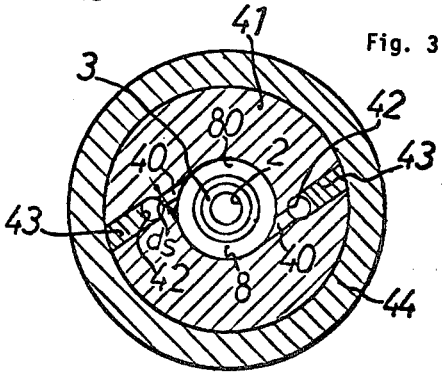
FIG. 3 is a transverse sectional view of the invention shown in FIG. 1.

Referring to FIGS. 1 to 3, there is shown a fuel injection valve $A_1$ which forms the first embodiment of the present invention and is of the fuel pressure operated type in which a needle valve is seated and unseated by fuel pressure and valve spring pressure to open and close a fuel induction passage and wherein the initial fuel injection pressure is adjusted by changing the thickness of a flat plate-like washer. The fuel injection valve $A_1$ has, at the fore end of a nozzle body 1, a nozzle member 4 which has a fuel injection port 2 and a conical valve seat 3 located inwardly of an communicating with the fuel injection port 2. The nozzle body 1 and the nozzle member 4 are centrally provided with a guide bore 13 and a needle valve guide bore 5 for slidably receiving a push rod 14 and a needle valve 6, respectively, through precision fitting. Within the nozzle member 4, the needle valve 6 has its fore end formed in a conical shape for airtight abutting engagement with the valve seat 3; to form a conical pressure receiving surface 16. When a jet of fuel is supplied intermittently, the fuel pressure acts against the pressure of a valve spring 60 of the needle valve 6 to open the passage between the valve seat 3 and needle valve 6, as will be described hereinafter. The nozzle member 4 is provided with a swirl chamber 8 which consists of a combination of concentric hollow truncated-cone and cylindrical sections, between the valve seat 3 and a conical pressure receiving surface 61 of the needle valve 6. The swirl chamber 8 has, in the first embodiment, a diameter $di \leqq 4mm$ and a height $h \leqq 1mm$.

These values are given only by way of example and the first embodiment is not limited to them in any way whatsoever. More particularly, the present inventors have already found that the most efficient swirl injection valve has an injection port and a swirl chamber which respectively satisfy $$di/de \leqq 2 \text{ and } h/de \leqq 0.5$$

where di is the diameter of the swirl chamber, h is the height of the swirl chamber and de is the diameter of the injection port; thereby resulting in a swirl injection valve which has optimum atomizing characteristics, which produces sprays of fine particles that have thus far been difficult to obtain at low injection pressures, which is very effective in accelerating the atomization, and which has a quick response to the injection pressure. Therefore, the dimensions of the respective parts should be determined by selecting values which satisfy the above-mentioned relations.

As shown in FIG. 3, the swirl chamber 8 communicates with tangential pressurized fuel supply passages 40 bored through the outer peripheral wall of the nozzle member 4 in a direction tangential to the inner periphery of the swirl chamber 8. The tangential pressurized fuel supply passages 40 have the axes of the respective outlets in a direction tangential to the inner peripheral 80 of the swirl chamber 8 and are designed to impart swirling movement about the axis of the swirl chamber to the pressurized fuel to be supplied thereto, with no velocity component of an axial direction, the outlets each being opened into the swirl chamber in the same direction as the swirling movement of the pressurized fuel or fluid. The nozzle member 4 and the nozzle body 1 have, in the respective side walls 41 and 11, a plurality of pressurized fuel induction passages 42 and 12 which are communicable with each other through an annular groove 412 which is provided between opposing end faces of the nozzle member 4 and the nozzle body 1. At one end, the pressurized fuel induction passages 42 communicate with the swirl chamber 8 through the tangential pressurized fuel passages 40 and with the injection port 2 through the valve device 9. At the other end, the pressurized fuel induction passages 12 communicate with a fuel source (not shown) through a fuel pump (not shown). The nozzle member 4 has plug members 43 secured integrally and in an airtight fashion into open bore portions on the outer side of the junctions of the tangential pressurized fuel supply passages 40 and the pressurized fuel induction passages 42, thereby plugging the unnecessary bore portions on the outer side of the aforementioned junctions. The nozzle body 1 has the nozzle member 4 secured to its fore end coaxially and integrally by threading a cap nut 44 on the threaded portion 45. The rear end of the needle valve 6 is in abutting relation with the push rod 14 which is mounted coaxially therewith and slidably received in the guide bore 13 in the nozzle body 1. The push rod 14 is provided with a spring seat 62 for one end of a valve spring 60 which urges the needle valve 6 toward the valve seat 3. The other end of the valve spring 60 is abutted through a washer 63 against the end of a closed bore 16 which is formed centrally of the nozzle body 1. Thus, a needle valve pressing mechanism 64 is constituted by the needle valve 6, push rod 14, valve spring 60 and washer 63. The pressing force of the needle valve pressing mechanism 64, which urges the needle valve 6 toward the valve seat, can be adjusted by replacing the washer 63 by another washer of different thickness. The just-mentioned pressing force opposes the fuel pressure which acts on the conical pressure receiving surface 61 of the needle valve 6.

Figure 4:
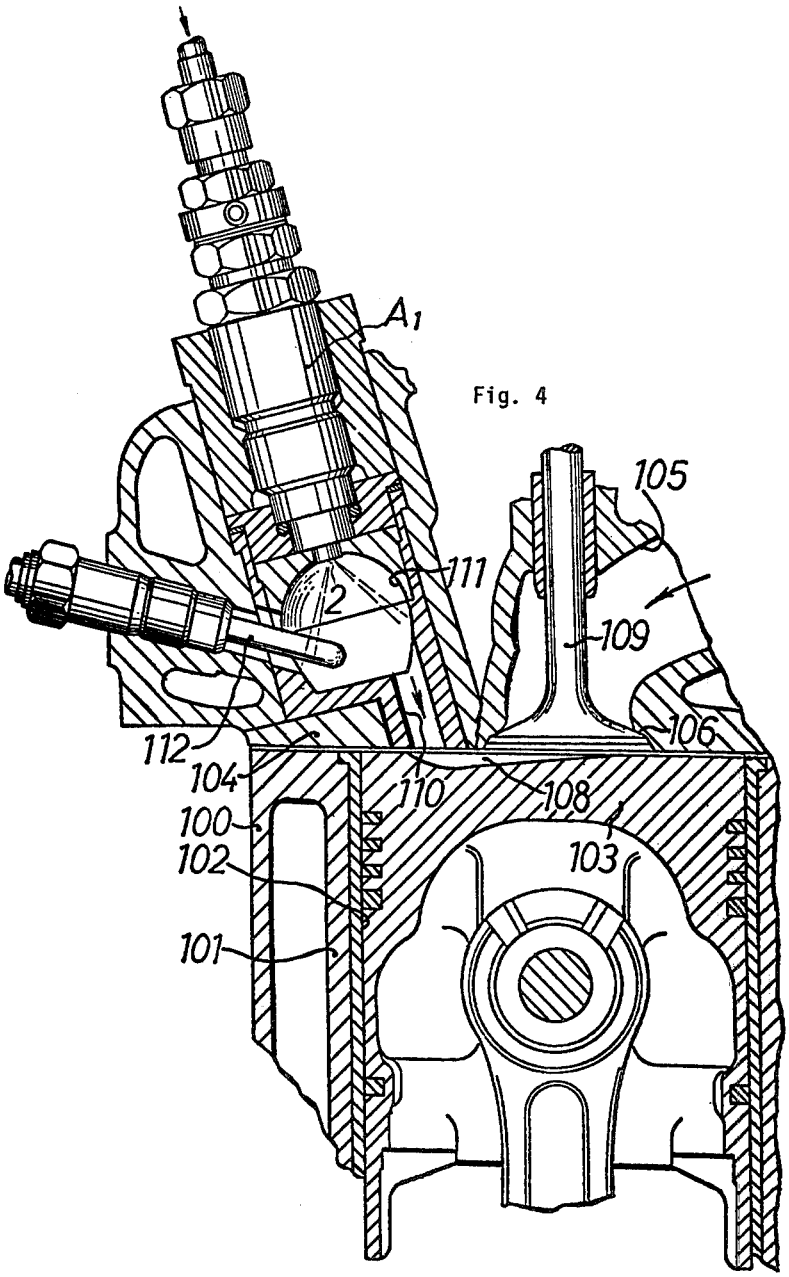
FIG. 4 is a sectional view, with parts broken away, showing the swirl injection valve of the first embodiment as applied to a diesel engine.

FIG. 4 shows the swirl injection valve $A_1$ of the first embodiment as applied to a diesel engine (compression ignition). The diesel engine 100 is provided with a cylinder 102 in a cylinder block 101 and a reciprocable piston 103 connected to a crank shaft by a connecting rod (both not shown). In a cylinder head 104, there are provided an intake port 106 which communicates with an intake passage 105, and an exhaust port which communicates with an exhaust passage (both not shown). Both ports are in communication with an exhaust passage (both not shown). Both ports are in communication with the combustion chamber 108 respectively through an intake valve 109 and an exhaust valve (not shown) which are controlled to open and close both ports at predetermined periods in synchronism with the rotation of the engine. An auxiliary combustion (or vortex) chamber 111 is provided over the combustion chamber 108 and communicates with the latter through passage 110. The injection port 2 of the above-described swirl injection valve $A_1$ opens into the bottom of the auxiliary combustion chamber 111 to inject a predetermined amount of fuel into the auxiliary combustion chamber 111 for predetermined time periods in relation to the operation of the engine. A starting glow plug 112 is provided in the auxiliary combustion chamber 111 in a position adjacent to the swirl injection valve $A_1$ for initially igniting the sprayed fuel by electric heat.

The swirl injection valve $A_1$ of the first embodiment, as constructed above, operates in the following manner.

During the up stroke of the piston 103, the air supplied to the combustion chamber 108 through the intake passage 105, intake valve 109 and intake port 106 is compressed to a high degree. In the meantime, the swirl injection valve $A_1$ injects the fuel into the auxiliary combustion chamber 111 with optimum atomization characteristics and response to injection pressure and, at the time of engine start, the injected fuel is ignited by the glow plug 112 whereupon the flames propagate into the combustion chamber 108 through the communicating passage 110. During the subsequent operation of the engine 100, the fuel injected into the auxiliary chamber 111 by the swirl injection valve $A_1$ is spontaneously ignited, and the flames propagate into the highly compressed air in the combustion chamber 108 through the communicating passage 110 and ignite the compressed air to complete its combustion.

To describe the operation of the swirl injection valve $A_1$ of the first embodiment in greater detail, the swirl injection valve $A_1$ has the injection port 2 normally closed by the needle valve 6 due to the pressing force of the needle valve pressing mechanism 64, as shown in FIG. 1. However, when fuel is supplied to and enters the swirl chamber 8 in synchronism with the reciprocating movement of the plunger of the fuel pump to increase the fuel pressure to a predetermined valve opening valve, the needle valve 6 is lifted against the pressing force of the afore-mentioned needle valve pressing mechanism 64 by action of the entering fuel against surface 61 to open the injection port 2, whereupon the fuel is permitted to flow from its source through the pressurized fuel induction passages 12 and 42 and the tangential pressurized fuel supply passages 40, and tangentially into the swirl chamber 8 having a small diameter and height. Within the swirl chamber 8, a strong and fast swirl flow is formed since the pressurized fluid, having no velocity component of an axial direction, is tangentially supplied to the swirl chamber. As a result, the fuel is injected through injection port 2 into the auxiliary combustion chamber 111 in the form of an atomized spray with optimum atomization characteristics and high atomization response to the injection pressure. Upon injecting the fuel through the injection port 2, a major part of the fuel pressure assumes a swirling velocity in the tangential direction while the remainder assumes an axial velocity, and the fuel advances along a straight line composed of the mean axial flow velocity and mean tangential velocity. Hence, a hollow liquid film of trumpet or bell shape is formed as a whole. As the injection pressure increases, the shape of the liquid film changes from a tulip shape (cone shape) to a bell shape and then to a trumpet shape with increased atomization. Since the liquid film becomes very thin when spaced in a trumpet shape, the peripheral portions of the film break up into a multitude of fine liquid particles which scatter in atomized condition.

When the swirl injection valve $A_1$ of the first embodiment is applied to the diesel engine 100, for instance, the swirl injection valve $A_1$ effects the opening and closing operation approximately 200–2500 times per minute. The representative shapes and dimensions of the swirl injection valve $A_1$ and the sprayed conditions of the fuel in relation to the various operating conditions of the diesel engine are as follows.

As for the swirl injection valve, the swirl chamber has a diameter $di \leqq 4$ mm and a height $h \leqq 1$ mm, the injection port has a diameter $de = 1$ mm and the tangential pressurized fuel supply passage has a diameter $ds = 0.4$ mm.

Figures 5, 6, 7, 8:
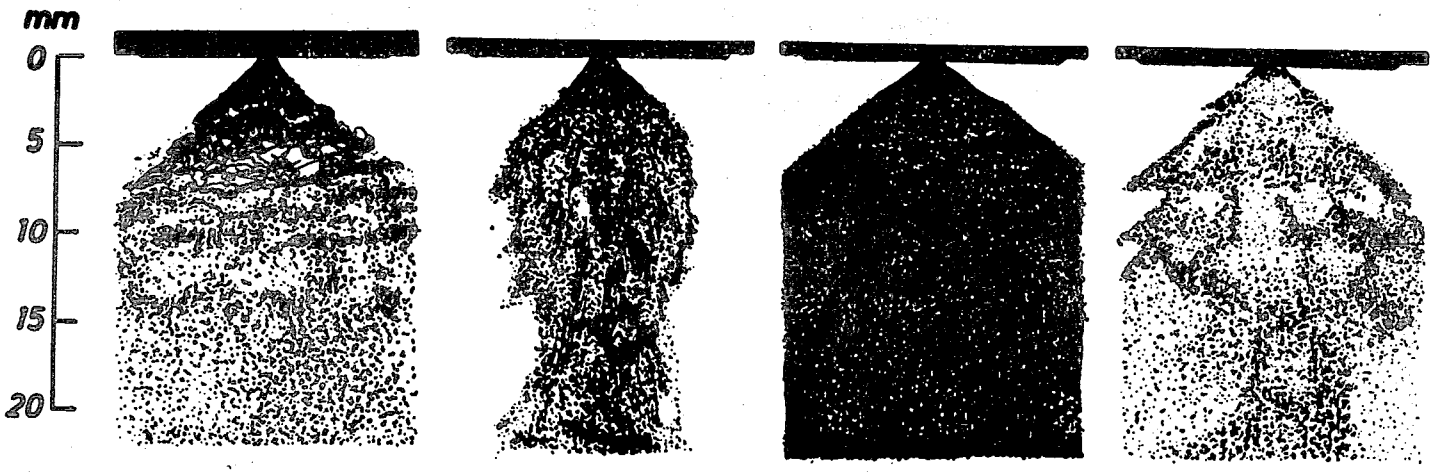
FIGS. 5 to 8 are views showing the conditions of sprays produced by the swirl injection valve of the first embodiment in relation with injection pressure.

Even at relatively low fuel pressure in the range of 2–5 kg/cm$^2$, the fuel is sprayed in the form of a trumpet and at a uniform flow rate as shown in FIG. 5, showing practically optimum atomization characteristics and producing a spray of fine particles which has conventionally been difficult to obtain and which is extremely effective in accelerating the atomization of the fuel, with a quick response to the injection pressure.

With a diesel engine operating under the conditions where the rotational speed of the fuel pump is $n = 750$ rpm, the injection valve opening pressure is $Pe = 50$ kg/cm$^2$, and the maximum pressure is $Pmax = 100$–$200$ kg/cm$^2$, the spray of fuel from the swirl injection valve $A_1$ is immediately spread in the form of a tulip at the initial time point of injection, as shown in FIG. 6. The spread liquid film becomes thin and is atomized in the distant portions from the injection port with relatively high density in the center portions and relatively low density in the peripheral portions, to be scattered with optimum atomization characteristics and quick response to the injection pressure. The spray is satisfactory practically without any dribbling or forming of coarse particles of fuel or other defects which are often encountered with the conventional injections valves.

In a continued injection operation of fuel by the swirl injection valve $A_1$, the spray is efficiently spread further from the tulip shape into a trumpet shaped, very thin liquid film as shown in FIG. 7 and the spread spray is atomized into extremely fine particles immediately and uniformly over a large area to be diffused and mixed with air, efficiently realizing sprays of atomized fuel particles which could not have been obtained by conventional injection valves.

Immediately before the completion of fuel injection by the swirl injection valve $A_1$, the spray still retains a liquid film of trumpet shape as shown in FIG. 8, and the peripheral portions of the injected spray retain a stepped trumpet form maintaining the uniformly atomized state until the completion of fuel injection with optimum atomization characteristics. Upon termination, the spray is immediately and effectively stopped, with the fuel supply instantly stopped without cut-off defects or after-dribbling of fuel, which are encountered in conventional fuel injection valves. Therefore, excellent practical effects can be achieved.

Figure 9:
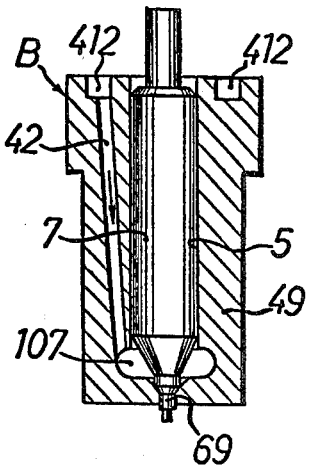
FIGS. 9 and 13 are sectional views showing various conventional injection valves.

It may be pointed out that the known fuel injection valves on the market are all complicated in shape and construction, and difficult to manufacture and assemble. As a representative thereof, FIG. 9 illustrates a nozzle member of a fuel pressure operated type injection valve B which has a piston nozzle 69. Upon comparing the fuel sprays produced by the fuel injection valve B and the above-described fuel injection valve $A_1$ of the first embodiment, it will be clear that the latter is far superior to the former. In FIG. 9, the needle valve 7, fuel chamber 107 and nozzle member 49 are different from the counterparts in the fuel injection valve $A_1$ in shape, construction and the manner in which they are assembled but like parts are designated by like reference numerals, omitting their explanations.

Figures 10, 11, 12, 14:
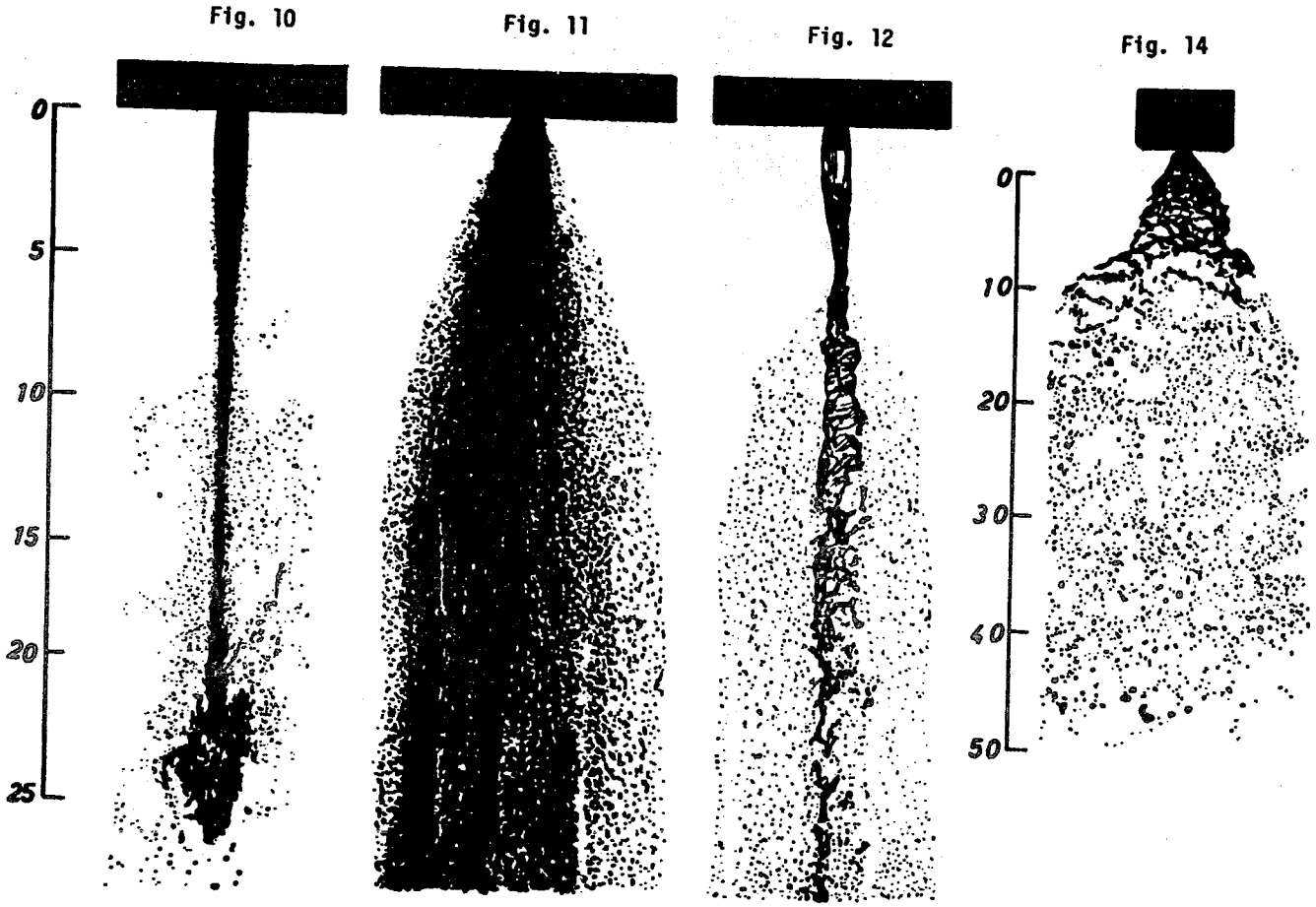
FIGS. 10 to 12 are views showing the conditions of sprays produced by the conventional injection valve of FIG. 9.
FIG. 14 is a view showing the condition of the spray produced by the conventional injection valve of FIG. 13.

Under conditions where the fuel pressure is 5 $kg/cm^2$, the rotational speed of the fuel pump is 1000 rpm, the injection valve opening pressure is $Pe=50-70$ $kg/cm^2$ and the maximum pressure is $Pmax=200-500$ $kg/cm^2$, at the initial time point of injection the fuel injection valve B produces a rod-like liquid film as shown in FIG. 10, without spreading. Extremely coarse particles and a film are assembled at a non-uniform flow rate in the distant portions from the nozzle 69, showing inferior atomization characteristics, extremely low atomization response to the injection pressure, and dripping of the fuel.

In continued injection of fuel by the valve B, the fuel appears in the form of a diverging liquid film of relatively small injection angle, as shown in FIG. 11. The moment the liquid film spreads, it becomes thinner with relatively higher density in the center portion distant from the nozzle 69 and lower density in the peripheral portions distant from the nozzle 69, forming a spray of particles having an average diameter greater than 50 μm. Therefore, excellent atomization characteristics and high response to the injection pressure cannot be obtained by the fuel injection valve B.

Immediately before the completion of injection by the valve B, the fuel is again injected in the form of a rod-like liquid film forming a continuation of extremely coarse particles in the distant portions from the nozzle 69 where no atomized particles are present. Upon termination of injection, the fuel supply cannot be stopped completely without cut-off failure and after-dribbling of fuel.

Figure 13:
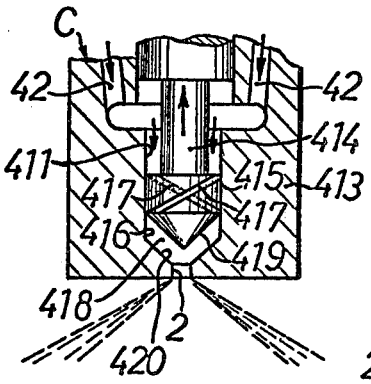

Among the swirl fuel injection valves already developed by the present inventors, there is a valve C taking the form shown in FIG. 13 (illustrating primarily the nozzle member). The swirl fuel injection valve C is provided with tangential pressurized fuel supply passages 417 on the outer peripheral surface 415 of a needle valve 414 which fits a needle valve guide bore 411 of a nozzle member 413. The tangential pressurized fuel supply passages 417 extend in a direction tangential to the inner periphery 416 of the needle valve guide bore 411 and inclined with respect to the axis of the needle valve 414. A swirl chamber 418 is provided between the lower end face 419 of the needle valve 414 and the inner wall surface 420 of the needle valve guide bore 411.

The swirl injection valve C is not suitable for mass production since it is extremely difficult to manufacture, machine and assemble the needle valve 414. In particular, the needle valve 414 often becomes defective because the tangential pressurized fuel supply passages 417 are beyond tolerance and are not acceptable due to the thermal treatment which is required to impart high abrasive and heat resistances to the valve. In addition, there are problems because the tangential passages 417 are deformed due to the wear by the repeated reciprocating movements of needle valve 414 and the clearance between the needle valve 414 and the needle valve guide 417 is widened. This causes trouble in injecting the necessary amount of fuel and requires repair and replacements of parts.

The condition of spray produced by the swirl injection valve C in continued injection is shown in FIG. 14, from which it will be seen that the spray lacks directional stability due to defects in fabrication and machining processes of the injection valve. There are problems in the atomization characteristics as well as in response to the injection pressure. More specifically, the spray injected from the valve C diverges like an unfolded fan with a greater injection angle as compared with that of the spray produced by the fuel injection valve B, but its liquid film injection deviates to one side of the axis of the injection port and becomes thinner toward the diverged portions. The spray has good atomization characteristics even in the distant portions, but the direction of injection is greatly deviated to one side with non-uniform spray distribution, so that it has a tendency of failing to effect appropriate fuel supply.

It will be clear from the foregoing that the swirl injection valve $A_1$ has distinctively excellent effects of atomization characteristics and high response to the injection pressure which cannot be attained by the fuel injection valve B and the swirl injection valve C. In addition, the swirl chamber 8 and the tangential pressurized fuel supply passages 40, which are the essential elements of the swirl injection valve $A_1$, can be provided effectively in the nozzle member 4 and the side wall portions of the pressurized fuel induction passages 42. Thus, the swirl injection valve $A_1$ is completely different from the conventional injection valves in that high precision manufacturing and machining can be effected simply by boring the tangential pressurized fuel supply passages 40 through the wall of the nozzle member 4 in communication with the pressurized fuel induction passage 42 and the swirl chamber 8. Moreover, by fitting the plug member 43 in the unnecessary open bores on the outer side of the junctions of the tangential pressurized fuel supply passages 40 and the pressurized fuel induction passages 42, pressurized fuel induction passages of high precision can be easily and simply formed to provide products of high quality with high production efficiency. Particularly, the swirl injection valve $A_1$ is simplified in the shape and construction of the nozzle member 4, with the resultant advantages that the manufacturing, machining and assembling become easier to suit to mass production as compared to conventional injection valves, and that the valve is free from various troubles, has increased durability, is easy to handle and can be produced at lower cost.

Moveover, the swirl injection valve $A_1$ of the first embodiment, when applied to the diesel engine 100, can effect the supply of injection fuel in an optimum manner so that it becomes possible to attain complete combustion of the fuel, prevent air pollution due to the production of toxic gases, ensure stable and smooth operation of the engine, and reduce the fuel consumption.

Figure 15:
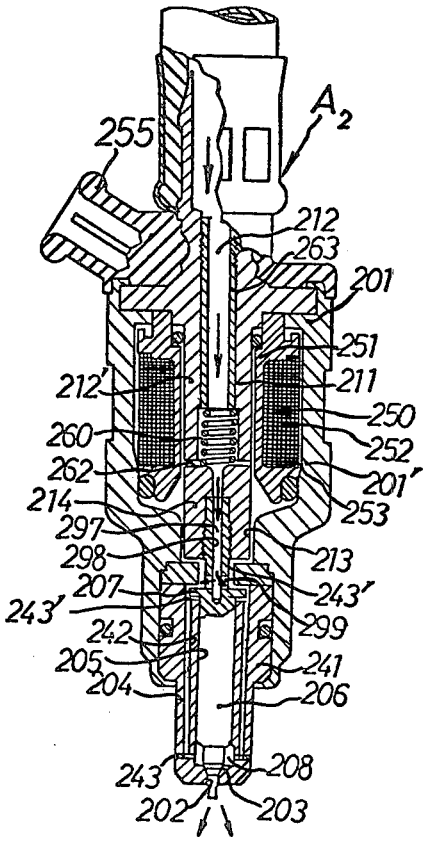
FIG. 15 is a longitudinal sectional view showing a swirl injection valve constituting the second embodiment of the invention.
Figure 16:
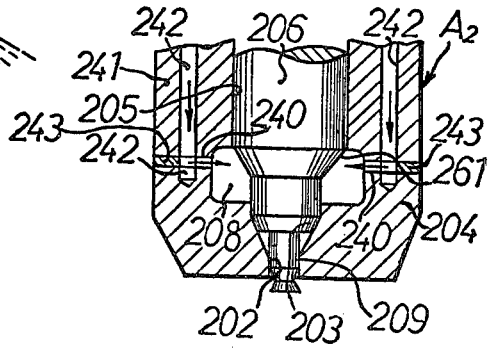
FIG. 16 is an enlarged sectional view of the end portion of the embodiment shown in FIG. 15.
Figure 17:
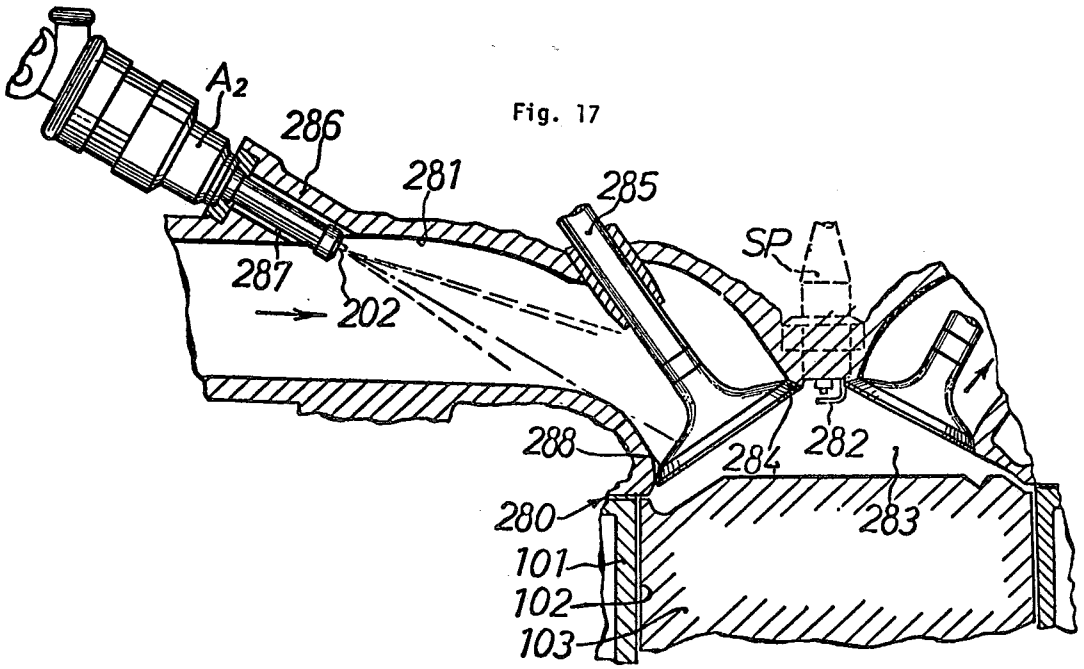
FIG. 17 is a sectional view showing the swirl injection valve of the second embodiment as applied to a gasoline engine.

The second embodiment of the present invention, swirl injection valve $A_2$, is of a type different from the above-described first embodiment and will now be described. As shown in FIGS. 15 to 17, in the swirl-injection valve $A_2$, a plunger is moved in response to an energizing pulse voltage which is applied to an electromagnetic coil, thereby seating and unseating the needle valve to control the opening and closing of the pressurized fuel induction passage, for controlling the amount of injected fuel, according to the length of the conduction periods of the electromagnetic coil. The electromagnetic or electronic swirl injection valve $A_2$ (or electronic fuel injector), has at the fore end of a nozzle body 201 a nozzle member 204 of a pintle type (including throttle type) nozzle, including a fuel injection port 202 and a conical valve seat 203 formed in an inner cavity of the nozzle member 204 in communication with the injection port. The nozzle body 201 and the nozzle member 204 are centrally provided with a needle valve guide bore 205 and a guide bore 213 for respectively slidably receiving a precision fitted needle valve 206 having a stopper 207, and a plunger 214 which is integrally connected to the needle valve 206. The needle valve 206, received in the nozzle member 204, forms a pintle type nozzle different from the first embodiment and has a conically shaped fore end for abutting engagement with the valve seat 203 in an airtight fashion. The needle valve is further provided with a valve device 209 for intermittently injecting fuel by the opening and closing operation of the needle valve 206 with the valve seat 203 which is controlled by energization and de-energization of the electromagnetic coil of electromagnetic needle valve control device 250. Between the valve seat 203 of the injection port 202 which is centrally located in the nozzle member 204 and a conical pressure receiving surface 261 provided at the fore end of the needle valve 206, there is provided a swirl chamber 208 which consists of a coaxial and connecting combination of hollow truncated cone and cylindrical sections. The swirl chamber 208 has about the same relation between its shape and its dimension (diameter di, height h and diameter of the fuel injection port de) as that of the first embodiment.

In the swirl injection valve $A_2$ of the second embodiment, the swirl chamber 208 is communicated with tangential pressurized fuel supply passages 240 which are formed through the side wall of the nozzle member 204. The nozzle member 204 has pressurized fuel induction passages 242 formed through its side wall 241 parallel with the axis of the swirl chamber 208, while the nozzle body 201 has a pressurized fuel induction passage 212 formed through its side wall 211 coaxially with the swirl chamber 208. These pressurized fuel induction passages 212 and 242 are communicable with each other through a fuel supply passage 297 and an annular groove or space 243' provided between the opposing end faces of the nozzle member 204 and the nozzle body 201. The passage 297 communicates with passage 242 through its center bore 298 and side openings 299, as seen in FIG. 15. At the lower end of valve $A_2$ (FIG. 16), the pressurized fuel induction passage 242 communicates with the fuel injection port 202 through the tangential pressurized fuel supply passages 240, swirl chamber 208 and valve device 209. At the upper end, the pressurized fuel induction passage 212 communicates with an externally provided fuel source (not shown) through its fuel pump (not shown). A spring seat 262 is provided on the plunger 214 for receiving one end of a valve spring 260 which urges the needle valve 206 into abutting engagement with the valve seat 203. The other end of valve spring 260 abuts one end of a hollow chamber 263 which is fitted in and integrally secured to the pressurized fuel induction passage 212. An annular electromagnetic needle valve control device 250, which controls the seating and unseating operation of the needle valve 206, is positioned within the side wall of the nozzle body 201 and around the pressurized fuel induction passage 212 in an airtight and insulated manner, as shown in FIG. 15. The electromagnetic needle valve control device 250 has a fixed iron core 251 in which a member 212' is coaxially fitted to form the pressurized fuel induction passage 212. An electromagnetic coil 252 is wound a plural number of turns around the outer periphery of the fixed core. A yoke 253 covers the electromagnetic coil 252 and at the same time secures the fixed iron core 251 in position. The outer wall member 201' of the nozzle core 201 encases the fixed core 251, electromagnetic coil 252, yoke 253 and nozzle member 241 integrally therein in an airtight and well-insulated manner. The fixed core 251 receives in its inner cavity one end of the afore-mentioned plunger 214. When an energizing pulse voltage is applied to the electromagnetic coil 252, the electromagnetic needle valve control device 250 produces an electromagnetic attractive force, thereby attracting the plunger 214 upwardly to open the fuel passage between the needle valve 206 and the valve seat 203 for fuel injection. As soon as the energizing pulse voltage to the electromagnetic coil 252 is cut off, the electromagnetic attractive force ceases and the plunger 214 is urged to descend by the action of the valve spring 260 to close the fuel passage between the needle valve 206 and the valve seat 203, thereby cutting off the fuel injection. The electromagnetic coil 252 is conductively connected to a connector 255 which, in turn, is connected to a computer (not shown) through suitable wiring (not shown) to receive electric injection signals which have been calculated by the computer, and amplified by a power amplifier (not shown).

The swirl injection valve $A_2$ of the second embodiment will now be described when applied to a gasoline engine (spark ignition), as shown in FIG. 17, in which those parts common to FIG. 14 are designated by common reference numerals.

The gasoline engine 280 is of the type in which the fuel is injected into the intake pipe. The intake system of the engine is as follows. In the upstream portion of an intake passage 281, there are provided (but not shown) an air filter and a throttle valve, the latter being opened and closed to control the amount of intake air. In the downstream portion of the intake passage, there are provided a combustion chamber 283 receiving a sparking head 282 of a spark plug SP, an intake port 284 communicable with the combustion chamber, and an intake valve 285 which performs the opening and closing control of the intake port. The swirl injection valve $A_2$ is air-tightly mounted in a mounting hole 287 which is provided in the wall 286 (intake manifold) of the intake passage 281, upstream of the intake valve 285, to inject the fuel toward the valve seat 288 of the intake valve 285.

The operational effects of the swirl injection valve $A_2$ of the second embodiment having the above-described arrangement will now be explained.

In the intake stroke of the gasoline engine 280, a predetermined amount of air is drawn into the combustion chamber 283 through the intake passage 281, throttle valve, intake valve 285 and intake port 284. At this moment, the swirl injection valve $A_2$ sprays the fuel toward the valve seat 288 with good atomization characteritics and response to the injection pressure, and the sprayed fuel efficiently and uniformly spreads into and mixes with the intake air to form a combustible mixture of predetermined air-fuel ratio. The air-fuel mixture taken into the combustion chamber 283 is compressed in the succeeding compression stroke and then ignited by the spark plug SP to effect and complete combustion in an appropriate manner.

To explain the operation of the swirl injection valve $A_2$ of the second embodiment more particularly, when the energizing pulse voltage to be supplied to the electromagnetic coil 252 is cut off to eliminate its electromagnetic force, the plunger 214 is urged to its lower position by the action of the valve spring 260, closing the fuel passage between the needle valve 206 and the valve seat 203, namely, closing the injection port 202. However, as soon as the energizing pulse voltage is applied to the electromagnetic coil 252 to produce electromagnetic attractice force, the plunger 214 is magnetically lifted against the force of the valve spring 260, opening the passage between the needle valve 206 and the valve seat 203, namely, opening the injection port 202. Simultaneously, the fuel flows through the pressurized fuel induction passages 212, 242 and the pressurized fuel supply tangential passages 240 into the swirl chamber 208, which has a small diameter and height similar to the first embodiment. Then, the fuel is swirled by tangentially supplying the pressurized fluid having no velocity component of an axial direction to the swirl chamber, and sprayed into the intake passage 281 in the form of a high velocity atomized spray with optimum atomization characteristics and atomization response to the injection pressure.

Following are examples of spray conditions which are obtained when the swirl injection valve $A_2$ of the second embodiment is applied to the above-described gasoline engine 280.

Figure 18:
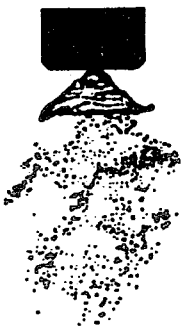

Under the gasoline engine operating conditions where the fuel pressure is 2 kg/cm$^2$ and the engine speed is n=1500 rpm, the spray produced by the swirl injection valve $A_2$ at an initial time point of injection immediately takes the form of a trumpet-like liquid film, as shown in FIG. 18. The moment the liquid film is spread, it becomes thinner and breaks up in the periphery portions, forming a spray of fine particles. The valve $A_2$ has excellent atomization characteristics and response to the injection pressure, attaining the same practical satisfactory effects as the swirl injection valve $A_1$ of the first embodiment.

Figure 19:
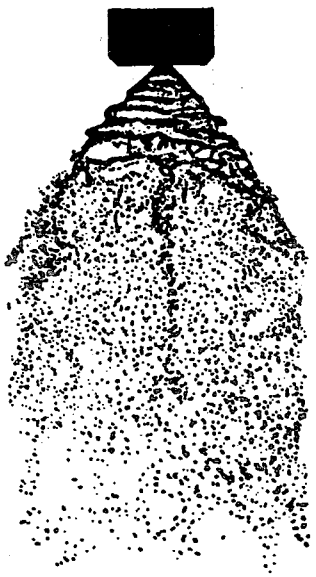

In continued injection, the swirl injection valve $A_2$ produces a spray of liquid film, the shape of which is more diverged than the trumpet shape, as shown in FIG. 19. The spread liquid film becomes thinner, and immediately and uniformly atomizes over a large area to form a spray of atomized fuel which easily diffuses and mixes with air, giving substantially the same effects as those of swirl injection valve $A_1$ of the first embodiment.

Figure 20:
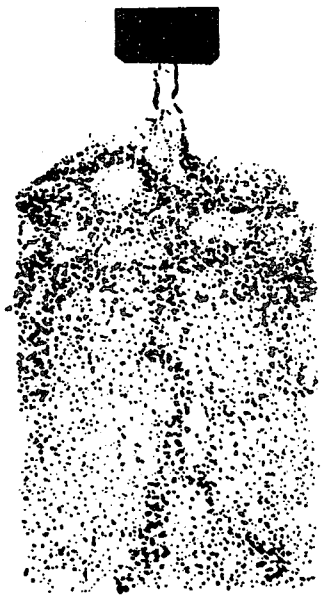
FIGS. 18 to 20 are views showing the conditions of sprays produced by the swirl injection valve of the second embodiment in relation with the injection pressure.

Upon completion of fuel injection, the swirl injection valve $A_2$ immediately cuts off the spray supply as shown in FIG. 20, ensuring the optimum atomization characteristics such that the sprayed fuel may retain the uniformly atomized state until the last time point and giving substantially the same effects as the swirl injection valve $A_1$ of the first embodiment.

The superiority of the spray conditions attained by the swirl injection valve $A_2$ of the second embodiment will be obvious upon comparing them with the spray conditions of the conventional electromagnetic fuel injection valve B which has a pintle nozzle 69 in the nozzle member 49, as shown in FIG. 8.

Figure 21:
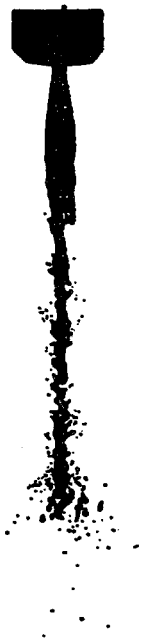
FIGS. 21 to 23 are views showing the conditions of sprays produced by a conventional electromagnetic injection valve.

More particularly, when the fuel injection valve B is applied to the gasoline engine 280 under the same fuel pressure and same engine speed as that of the second embodiment, at the initial time point of injection, the injected fuel takes the form of a rod-like liquid film, as shown in FIG. 21, without spreading and in the distant portions from the injection port, the injected fuel spreads to form an assembly of extremely coarse particles where the flow rate of fuel is non-uniform and there are no atomized particles, showing defective atomization characteristic, low response to the injection pressure, and dripping of the fuel.

Figure 22:
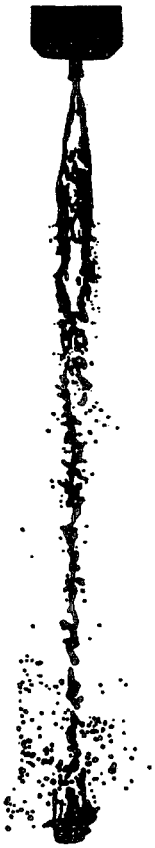

In the continued fuel injection by the fuel injector valve B, the fuel is injected in the form of a liquid film with a relatively small injecting angle, as shown in FIG. 22. The liquid film becomes thinner as soon as it is spread and becomes an assembly of very coarse particles and liquid films in the distant portions from the injection port, thereby failing to attain good atomization even at this time point. It is difficult in practice to obtain the excellent atomization characteristics and high response to the injection pressure attained by the swirl injection valve $A_2$ of the second embodiment.

Figure 23:
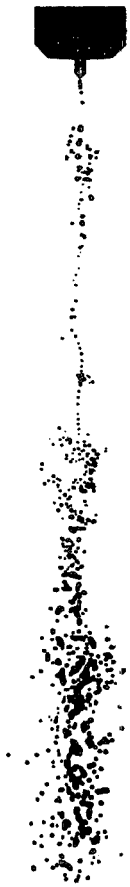

Further, at the time point immediately before the completion of injection by the fuel injector valve B, the fuel is injected in the form of an assembly of very coarse particles and the liquid film, as shown in FIG. 23, fails to completely stop the injection at the final point, resulting in cut-off failures and after-dribbling of the fuel.

It will be seen from the foregoing description that the swirl injection valve $A_2$ of the second embodiment realizes distinctly improved atomization characteristics and response to the injection pressure which cannot be achieved by the fuel injection valve B or swirl injection valve C. In addition, the swirl injection valve $A_2$ of the second embodiment has a great advantage in that it is simplified in shape and construction, and extremely easy to manufacture, machine and assemble to suit mass production, as compared with conventional counterparts. It further has practical advantages because it is free from various troubles, excellent in durability and reliability, easy to handle and low in cost.

Moreover, when swirl injection valve $A_2$ of the second embodiment is applied to the intake pipe injection type gasoline engine 280 (spark ignition engine), the fuel can be supplied in an optimum manner as described hereinbefore so that it becomes possible to effect complete combustion, suppress generation of toxic gases, prevent air pollution by exhaust gases, stabilize and smoothen the operation of the engine, improve various operational efficiencies of the engine considerably, and reduce the fuel cost to a significant degree.

Figure 24:
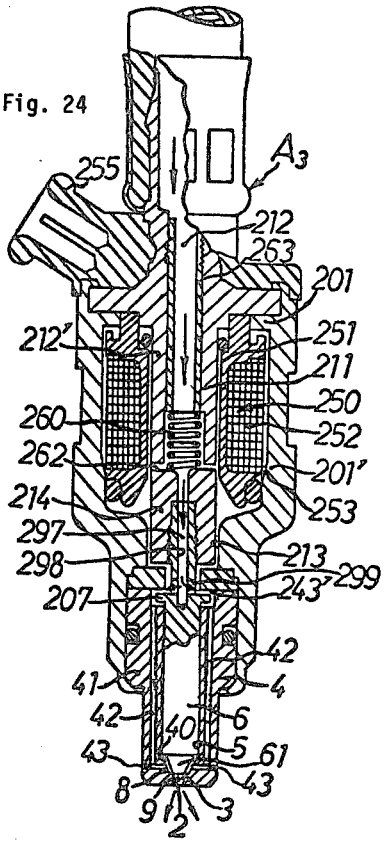
FIG. 24 is a longitudinal sectional view showing a swirl injection valve constituting the third embodiment of the present invention.
Figure 25:
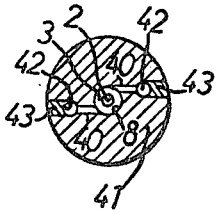
FIG. 25 is a transverse sectional view of the embodiment shown in FIG. 24.
Figure 26:
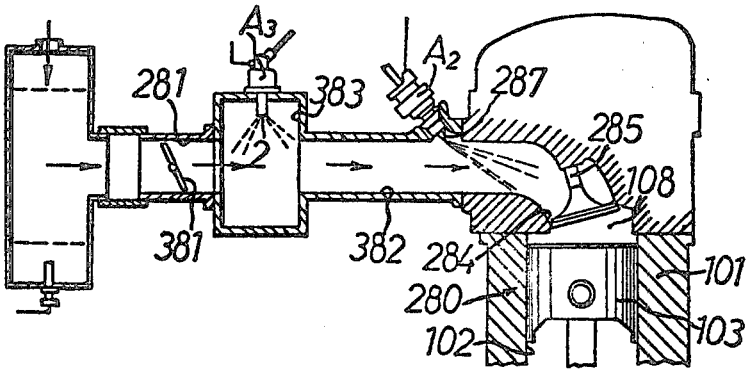
FIG. 26 is a section view showing the swirl injection valve of the third embodiment applied as a cold start injector.

The swirl injection valve $A_3$ forming the third embodiment of the invention is shown in FIGS. 24 to 26 and is suited to a start injector. The shape and construction of the electromagnetic needle valve control device are the same as those of the second embodiment. Also, the shape and construction of the nozzle member and the needle valve, are the same as those of the first embodiment so that common component parts are designated by common reference numerals.

The swirl injection valve $A_3$ of the third embodiment is different from the foregoing embodiments mainly in those points which will be mentioned in the following description. Upon application of the energizing pulse voltage to the electromagnetic coil 252, the needle valve control device 250 generates an electromagnetic attracting force to pull the plunger 214 upwardly against the action of the valve spring 260, thereby opening the fuel passage between the needle valve 6 and valve seat 3 of the valve device 9 for injecting, through the injection port 2, the fuel which is supplied through the pressurized fuel induction passages 212, 242, tangential pressurized fuel supply passage 40, and swirl chamber 8 to form a strong and fast swirl flow therewithin. As soon as the energizing pulse voltage is cut off, the electromagnetic attractive force of the needle valve control device 250 ceases and the plunger 214 is urged downwardly by the spring force of the valve spring 260 to close the passage between the needle valve 6 and valve seat 3, cutting off the injection and supply of the fuel.

FIG. 26 shows the swirl injection valve $A_3$ of the third embodiment as applied to a cold start injector of a gasoline engine (spark ignition engine). The swirl injection valve $A_3$ is air-tightly mounted at the center of the top wall of a surge tank 383 disposed between a throttle valve 381 in the intake passage 281 and the intake pipe 382 for the purpose of improving the starting performance under cold temperature conditions. The injection valve $A_3$ has its injection port 2 facing the interior of the surge tank 383.

The swirl injection valve $A_3$ of the third embodiment operates in the following manner. The swirl injection valve $A_3$ is operated by a thermo-time switch (not shown) in the engine which operates only under conditions when the engine cooling water temperature is below approximately 35° C. to inject fuel with optimum atomization characteristics and high atomizing response to the injection pressure. Once the engine is started, the thermo-time switch is de-energized to immediately stop the fuel injection by the swirl injection valve $A_3$, cutting off the fuel immediately without after-dribbling. The cold start injector of this type requires the fuel to be supplied in optimumly atomized conditions in order to improve the starting performance of the engine when the engine cooling water temperature is low. The swirl injection valve $A_3$ of the third embodiment is particularly suitable for a start injector and superior to the conventional counterparts in fuel atomizing characteristics and in the atomizing response to the injection pressure.

Following are explanations of conditions of the sprays of fuel injected by the swirl injection valve $A_3$ of the third embodiment which have been applied as a start injector of the aforementioned gasoline engine 280.

Figure 27:
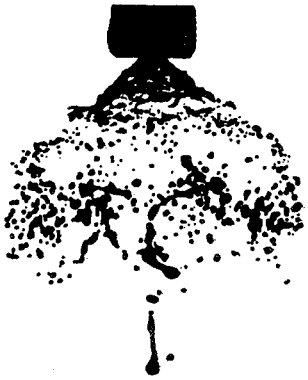
FIG. 27 is a view showing the condition of spray produced by a cold start injector using the conventional swirl injection valve.

At an initial time point of fuel injection by the swirl injection valve $A_3$, the fuel is injected immediately in the form of a trumpet-shaped liquid film. The liquid film becomes thinner as it is spread and breaks up in the peripheral portions into a multitude of atomized particles, showing optimum atomization characteristics and high atomizing response to the injection pressure from the initial point of injection. Hence, the swirl injection valve $A_3$ of the third embodiment has great utility as a start injector since its use effectively precludes coarse fuel particles which appear due to fuel stagnation in the spray (FIG. 27) at the initial time point of injection by conventional swirl injection valves used as a start injector (not shown). In addition, almost the same effects to the foregoing embodiments can be achieved.

Figure 28:
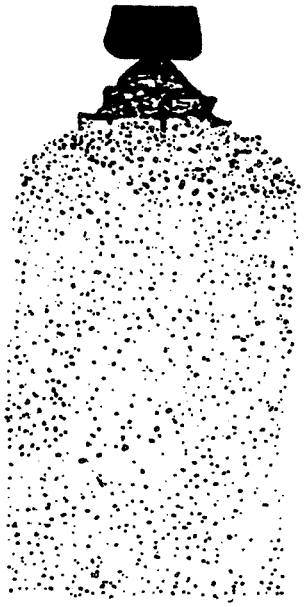
FIGS. 28 and 29 are views showing the conditions of sprays produced by the swirl injection valve of the third embodiment in relation with the injection pressure.

In the continued injection by the swirl injection valve $A_3$, the fuel is injected in the form of a liquid film of trumpet shape as shown in FIG. 28, and as soon as it spreads, the liquid film becomes thinner and is uniformly atomized over a large area to produce a spray of atomized fuel which diffuses with air in the same manner as in the foregoing embodiments.

Figure 29:
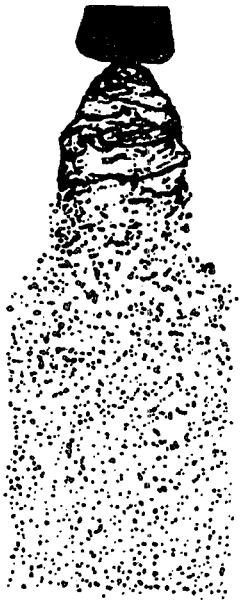

At a time point immediately before termination of injection by the swirl injection valve $A_3$, the fuel is injected in the form of a liquid film of tulip shape, as shown in FIG. 29. The injected fuel becomes thinner in the distant portions and maintains an uniformly atomized state, showing the optimum atomization characteristics until the termination of injection, when the fuel injection is cut off in the same manner as in the foregoing embodiments.

It will be seen from the foregoing description that the swirl injection valve $A_3$ of the third embodiment is particularly useful as a start injector and can contribute to improve the starting operation of the engine and to maintain its stable, smooth and efficient operation. By use of the swirl injection valve $A_3$, practical effects are obtained which could not have been attained by the conventional valves. In other respects, the swirl injection valve $A_3$ of the third embodiment has the same effects as the foregoing embodiments.

Figure 30:
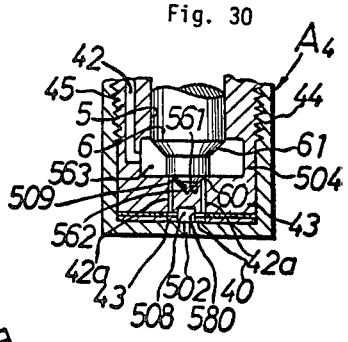
FIG. 30 is a partially cut-away sectional view showing a swirl injection valve constituting the fourth embodiment of the present invention.

The swirl injection valve $A_4$, which appears in FIG. 30 and constitutes the fourth embodiment of the present invention, differs from the foregoing embodiments mainly in that a swirl chamber 508 is formed in the wall of a nozzle member 504 and at a position downstream of a valve device 509. In other respects, it has the same construction as the foregoing embodiments. The following description is focused mainly on the different points, in which common parts are designated by common reference numerals and their explanations are omitted.

The nozzle member 504 has a bottomed swirl chamber 508 bored coaxially into the center of its fore end. The swirl chamber 508 is in communication with tangential pressurized fuel supply passages 40 which are formed through the side wall of the nozzle member 504 in a direction tangential to the inner periphery of the swirl chamber 508. These tangential pressurized fuel supply passages are in communication with pressurized fuel induction passages 42*a* which are formed through the bottom wall of the nozzle member 504 in parallel relation with the central axis of the bore of the needle valve chamber 5, needle valve 6, nozzle member 504 and swirl chamber 508. Plug members 43 are hermetically and integrally fitted into bore portions which are located on the outer sides of junctions of the tangential fuel supply passages 40 and the fuel induction passages 42*a*. A box nut 44 is coaxially and integrally fixed to the outer periphery of the fore or lower end of the nozzle member 504 by a threaded portion 45. The box nut 44 has an injection port 502 on its axis in coaxial relation with the bore of the needle member 504. The above-mentioned pressurized fuel induction passage 52*a* opens between a conically shaped apex end 561 of the needle valve 6, located forward of its conical pressure receiving surface 61, and a conical valve seat 562. A fuel sink 563 is bored in the wall of the nozzle member 504 between the conical pressure receiving surface 61 of the apex end 561 of the needle valve 6, in communication with the pressurized fuel induction passages 42. In the swirl injection valve $A_4$ of the fourth embodiment, the apex end 561 of the needle valve 6 is constantly urged to seat on the valve seat 562 by the action of the valve spring, where it blocks communication between the fuel sink 536 and the fuel induction passages 42*a* and cuts off the fuel supply. The passage between the apex end 561 of the needle valve 6 and the valve seat 562 is opened when the needle valve 6 is lifted against the action of the valve spring, communicating the fuel sink 563 with the fuel induction passages 42*a* to supply the fuel through the tangential passages 40 and swirl chamber 508 and spray it outwardly through the injection port 502.

Figure 31:
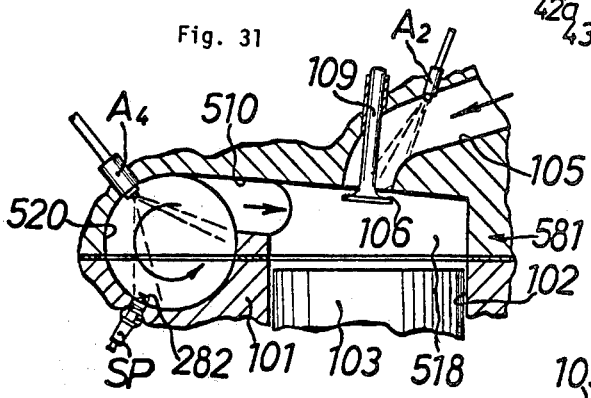
FIGS. 31 and 32 are sectional views showing the swirl injection valve of the fourth embodiment as applied to a pre-chamber type gasoline engine.
Figure 32:
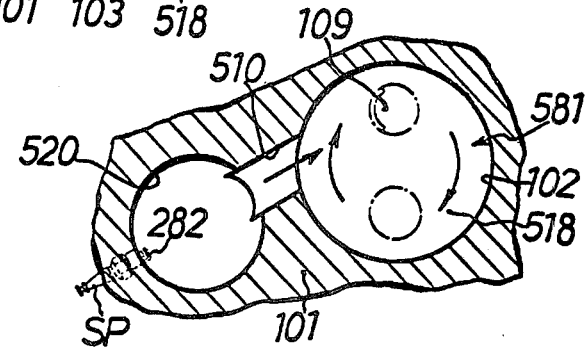

FIGS. 31 and 32 illustrate the swirl injection valve $A_4$ of the fourth embodiment as applied to a gasoline engine 581 with an auxiliary combustion chamber.

The main combustion chamber 518 receives through the intake valve 109 a lean air-fuel mixture consisting of the air which is taken in through the intake passage 105 and the sprayed fuel from the swirl injection valve $A_2$. The main combustion chamber 518 communicates with the auxiliary combustion chamber 520 through an intercommunicating bore 510 which is formed tangentially to generate vortical flows. The swirl injection valve $A_4$ is mounted with its injection port 502 disposed within the auxiliary combustion chamber 520 to inject a predetermined amount of fuel into the auxiliary combustion chamber 520 with a predetermined timing in synchronism with the engine operation, and supply a rich air-fuel mixture to the auxiliary combustion chamber 520 which has already been supplied with a lean air-fuel mixture. A spark plug SP is also provided in the auxiliary combustion chamber 520 with its sparking portion 282 disposed at a predetermined distance from the swirl injection valve $A_4$.

In this arrangement, the swirl injection valve $A_4$ of the fourth embodiment and the pre-chamber type gasoline engine 581 operate in the following manner.

In the intake stroke, the gasoline engine 581 is supplied with a lean air-fuel mixture in the main combustion chamber 518, whereas a rich air-fuel mixture is formed in the auxiliary combustion chamber 520. Then, the rich air-fuel mixture in the auxiliary combustion chamber 520 is ignited by the spark plug SP and burned therein, the flames of which propagate into the main combustion chamber 518 to ignite and burn the lean air-fuel mixture to complete stratified combustion appropriately.

In addition to the excellent atomization characteristics and response to the injection pressure attained in the preceding embodiments due to the formation of a strong and fast swirl flow within the swirl chamber 508, the swirl injection valve $A_4$ of the fourth embodiment also has an advantage in that it is simple in construction to facilitate its manufacturing, machining and assembling processes, coupled with its practical merits such as trouble-free durability, reliability and easy handling. Furthermore, the swirl injection valve $A_4$ applied to the pre-chamber type gasoline engine 581 serves to effect efficiency stratified combustion, preventing the generation of toxic cases, stabilizing and smoothening the engine operation, enhancing the efficiencies of various operations, and reducing the fuel cost.

In summary, the swirl injection valve according to the present invention comprises an injection port provided at the fore end of a nozzle body for injecting a pressurized fluid to be supplied, a pressurized fluid induction passage provided in the wall of said nozzle body in communication with said injection port and a pressurized fluid supply source, a valve device mounted in said pressurized fluid induction passage to control the fluid injection by on-off controlling the fuel supply to said injection port, a swirl chamber provided in the wall of said nozzle body at a position proximal to and in communication with said injection port, and tangential pressurized fuel supply passages, each of which has one end which communicates with a corresponding one of said pressurized fluid induction passages and the other end which opens into said swirl chamber in a direction tangential to the inner periphery thereof to impart swirling movement about the axis of said swirl chamber to the pressurized fluid to be supplied thereto, said pressurized fluid being injected with a predetermined timing.

The above-described swirl injection valve of the present invention has a remarkably improved construction. Particularly, the swirl injection valve differs from the conventional counterparts in that it has the pressurized fluid induction passage, for example, the tangential pressurized fluid supply passage bored from outside through the wall of the nozzle body in communication with the swirl chamber and the pressurized fluid induction passage, allowing the manufacture and machining of the nozzle member efficiently and with high precision. In addition, a pressurized fluid induction passage of high precision can be formed by fitting a plug member in the unnecessary bore portions on the outer side of the junction of the tangential pressurized fluid supply passage and the pressurized fluid induction passage, making it possible to improve the quality of the products with high working efficiency and in a simplified manner. Therefore, there can be provided a swirl injection valve of a simplified construction through extremely facilitated manufacturing, machining and assembling processes, suitable for mass production, while assuring excellent durability, reliability and ease of handling of the valve at a reduced cost. Furthermore, the valve of the present invention forms a strong and fast swirl flow within the swirl chamber by tangentially supplying the pressurized fluid having no velocity component of an axial direction into the swirl chamber, so that the valve has the practical effect of spraying the pressurized fluid with optimum atomization characteristics and high response to the injection pressure. Therefore, it is capable of various applications in diversified industrial fields. For instance, it can be applied to an internal combustion engine to effect appropriate fuel supply for complete combustion of the fuel while preventing generation of toxic gases which cause air pollution, stabilizing and smoothening the engine operation, improving the efficiency of various operations by the engine, and reducing the fuel cost.

The swirl injection valve according to the present invention is not limited to the particular embodiments illustrated in the foregoing description and allows various modifications and alterations as shown below, where those parts common to the foregoing embodiments are designated by common reference numerals.

Figure 33:
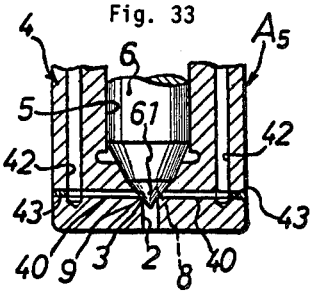
FIGS. 33 and 34 are partially cut-away longitudinal sectional views showing further embodiments of the present invention.

For example, the swirl injection valve $A_5$ with the nozzle member 4 shown in FIG. 33 may have the swirl chamber 8 constructed such that when the needle valve 6 is seated on the valve seat 3 by the action of the valve spring or other biasing force, it is completely occupied by the needle valve 6, to block the communication between the injection port 2 and the tangential fuel supply passages 40 by the conical fore end of the needle valve 6. The swirl chamber 8 is formed in a hollow conical shape defined by the outer wall portions of the conical fore end of the needle valve 6 and the inner peripheral wall of the valve seat 3 when the needle valve 6 is lifted against the action of the valve spring or other valve biasing force. In this instance, the fuel is supplied to the swirl chamber 8 through the pressurized fuel induction passages 42 and the tangential fuel supply passages 40, and injected outwardly through the injection port 2, with optimum atomization characteristics and quick response to the injection pressure in a manner similar to the above-described embodiments.

Figure 34:
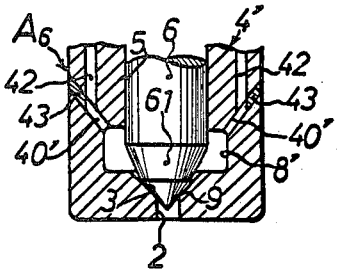

Further, the swirl injection valve $A_6$ with the nozzle member 4' shown in FIG. 34 may be constructed such that a substantially cylindrical swirl chamber 8' is provided in the wall of the nozzle member 4' at a position located above the conical pressure receiving surface 61 of the needle valve 6. The tangential pressurized fuel supply passages 40 which tangentially open into the swirl chamber 8' may not necessarily be provided in one and the same plane as in the foregoing embodiments and may be provided in different planes. For instance, as shown in FIG. 34, the tangential fuel supply passages 40' may be disposed to tangentially open into the swirl chamber 8' through its upper wall portion, with the axis of each passage inclined with respect to the axis of the coaxially mounted nozzle member 4' and needle valve 6, to thereby increase the efficiency of fuel supply to the swirl chamber 8' and to accelerate the swirling flows within the swirl chamber 8'. The swirl injection valve $A_6$ of this construction has the same effects as the foregoing embodiments.

In addition to the foregoing embodiment, the swirl injection valve of the present invention may be operated by mechanical actuation or a pressure accumulating chamber to attain the same operations and effects as in the preceding embodiments. The swirl injection valve of the invention is applicable not only to the internal combustion engines of the foregoing embodiments but also to the diesel or gasoline engines of the type which requires injection of fuel into a combustion chamber which is formed in the piston head or the engines which use both a carburetor and a fuel injection nozzle.

Moreover, the swirl injection valve of the present invention is not limited to the values given in the foregoing embodiments with respect to the diameter and height of the swirl chamber and the diameter of the injection port, and may employ other dimensions.

Furthermore, it may be mentioned that the swirl injection valve of the invention may be provided with at least one pressurized fluid induction passage and at least one tangential pressurized fluid supply passage leading to the swirl chamber, in addition to those shown in the preceding embodiments.

It should be understood that the present invention is not limited to the embodiments which have the tangential pressurized fluid supply passages bored through the wall of the nozzle body into communication with the swirl chamber and the pressurized fluid induction passages, but may be embodied in the form which has other pressurized fluid induction passages bored in a similar manner alone or in combination with the tangential fluid supply passages. Similarly, the plug member may be used not only for closing the tangential fluid supply passage but for closing unnecessary bore portions of other fluid induction passages.

What is claimed is:

1. A swirl injection valve comprising a nozzle body, an injection port opening at an end of said nozzle body for injecting pressurized fluid, at least one pressurized fluid induction passage provided within said nozzle body, said pressurized fluid induction passage being connectable to a pressurized fluid supply source, a valve means having a movable member interposed into said injection port for controlling the fluid injection by on-off controlling the fuel supply to said injection port, a swirl chamber comprising a chamber having circular cross section formed at a position adjacent to said injection port within said nozzle body, said swirl chamber being connected to said injection port, and two tangential pressurized fluid supply passages formed within said nozzle body, which respectively open into a side wall of said swirl chamber in the tangential direction thereof at symetrically opposite portions with respect to the axis of said swirl chamber in order to form a swirl flow of said pressurized fluid within said swirl chamber, each of said two tangential pressurized supply passages being connected to the respective one of said pressurized fluid induction passages within said nozzle body at a pre-determined angle, and being formed by a hole penetrating from an outer side wall to an inner side wall forming said swirl chamber, and a plug member being inserted into said hole from said outer side wall to said connecting part of said hole and said passage, said injection port, pressurized fluid induction passages, swirl chamber and tangential pressurized fluid supply passages being formed within said one nozzle body, whereby the swirl flow of said pressurized fluid may be injected in a pre-determined timing determined by said valve means.

2. A swirl injection valve according to claim 1, wherein said movable member is spring biased and is intermittently movable by the fluid pressure of the intermittently supplied fluid.

3. A swirl injection valve according to claim 1, wherein said valve means includes a plunger connected to said movable member located at a predetermined position relative to said pressurized fluid induction passage and said tangential pressurized fluid supply passage, thereby controlling the fuel supply to said injection port by the intermittent movement of said plunger.

4. A swirl injection valve according to claim 1, wherein said valve means includes a chamber interposed in said pressurized fluid induction passage, said movable member being positioned within said chamber in order to control the opening or closing of the communication between said chamber and pressurized fluid induction passage by the axial movement of said movable member.

5. A swirl injection valve according to claim 1, wherein said valve means comprises an opening of said tangential pressurized fluid supply passage in said swirl chamber and said movable member interposed in said swirl chamber and pressurized by a spring means, thereby controlling the opening or closing of the communication between tangential pressurized fluid supply passage and said swirl chamber by the axial movement of said movable member.

6. A swirl injection valve according to claim 1, wherein said swirl chamber is formed by an inner side wall of a hollow tip portion of said nozzle body and an outer side wall of a truncated-cone tip portion of said movable member.

7. A swirl injection valve according to claim 1, wherein said swirl chamber is formed by an inner side wall of a hollow tip portion of said nozzle body and outer side wall of a narrow stepped cylindrical tip portion of said movable member, the diameter of said inner side wall of said tip portion of said nozzle body being larger than that of said outer side wall of said tip portion of said movable member.

8. A swirl injection valve according to claim 1, wherein said swirl chamber comprises a cylindrical chamber provided at a tip portion of said nozzle body, and said injection port is coaxially formed at a bottom surface of said cylindrical chamber.

9. A swirl injection valve according to claim 1, wherein said nozzle body comprises a main body of a hollow member having a bottomed portion and a threaded part at a lower outer side wall thereof, an annular member, a stepped hollow member having a bottom portion, and a hollow adapter member having two threaded parts respectively at upper inner side wall and lower outer side wall thereof and stepped inner wall, said injection port comprises a small hole having a predetermined diameter coaxially provided at said bottom portion of said stepped hollow member of said nozzle body, said pressurized fluid induction passage comprises a passage axially formed in a side wall of said main body, a first circular groove coaxially formed at a top surface of said annular member, two passages connecting to said circular groove coaxially formed in a side wall of said annular member, a second circular groove coaxially formed at a top surface of said stepped hollow member and connected to said two passages of said annular member, and two passages axially formed in a side wall of said stepped hollow member and connected to said second circular groove, said valve means comprises said movable member comprising a needle valve having a conical top portion inserted within an inner side wall of said stepped hollow member, a conical push rod inserted within an inner portion defined by side walls of said main body and annular member and connected to said needle valve, and a coil spring for pressing said push rod inserted within an inner portion defined by side wall and a wall of said bottom portion of said main body, said swirl chamber is formed by said conical top portion of said needle valve and a tapered bottom surface of said bottom portion of said stepped hollow member, each of said two tangential pressurized fluid supply passages is connected to the respective one of said two passages at a right angle and is formed by a hole penetrating from an outer side wall to an inner side wall forming said swirl chamber of said stepped hollow member and a plug member inserted into said hole from said outer side wall to said connecting part of said hole and said passage, said two tangential pressurized fluid supply passages being provided in the plane perpendicular to the axis of said swirl chamber.

10. A swirl injection valve according to claim 9, wherein said nozzle body is provided at an auxiliary combustion chamber having a glow plug connected to said main combustion chamber of a diesel engine, and said swirl chamber has relations of $di/de \leqq 2$ and $h/de \leqq 0.5$ wherein di is the diameter of the swirl chamber, h is the height of the swirl chamber and de is the diameter of the injection port.

11. A swirl injection valve according to claim 1, wherein said nozzle body comprises a main body of a hollow member which comprises two parts having two different diameters, a hollow plug member having electric and fluid connectors equipped in a top portion of said main body, a hollow intermediate member having a cross shaped longitudinal section interposed within an inner wall of said large diameter part of said main body, an annular member inserted in the annular part of said main body, a stepped hollow member having 0 ring and a bottom portion fixedly inserted within a lower inner wall of said smaller part of said main body, said injection port comprises a small hole having a predetermined diameter coaxially provided at said bottom portion of said stepped hollow member of said nozzle body, said pressurized fluid induction passage comprises a tube inserted within an inner wall of said intermediate member and connected to said fluid connectors of said plug member of said nozzle body, a tube inserted within a stepped inner wall of said annular member, and embedded into a top portion of said stepped hollow member, said tube within said annular member having a plurality of holes at lower portions thereof and two passages axially provided at a side wall of said stepped hollow member and connected to said holes of said tube within said annular member, said valve means comprises said movable member comprising a needle valve having a tip portion of reduced diameter inserted within said inner wall of said stepped hollow member and injecting port and projected from an outer bottom surface of said injecting port, said hollow plunger connected to said needle valve by said tube having holes, coil means for pressing said hollow plunger inserted within said stepped inner wall of said intermediate member, and magnetic coil connected to said electric connector of said plug member fixedly inserted between an inner wall of said large part of said main body and lower outer wall of said intermediate member, said swirl chamber is formed by said stepped outer wall having a small diameter of said needle valve and an enlarged inner circular wall having large diameter of said stepped hollow member, each of said two tangential pressurized fluid supply passages is connected with the respective one of said two passages at a right angle and is formed by a hole penetrating from an outer side wall to said inner enlarged side wall of said stepped hollow member and a plug member inserted into said hole from said outer side wall to said connecting part of said hole to end said passage, said two tangential pressurized fluid supply passages provided in the plane perpendicular to the axis of said swirl chamber.

12. A swirl injection valve according to claim 11, wherein said nozzle body is provided at a side wall of an intake pipe adjacent to an intake valve in gasoline engine, and said swirl chamber has relations of $di/de \leqq 2$ and $h/de \leqq 0.5$ wherein di is the diameter of the swirl chamber, h is the height of the swirl chamber and de is the diameter of the injection port.

13. A swirl injection valve according to claim 1, wherein said nozzle body comprises a main body of a hollow member which comprises two parts having two different diameters, a hollow plug member having an electric and fluid connectors equipped in a top portion of said main body, a hollow intermediate member having a cross shaped longitudinal section interposed within an inner wall of said large diameter part of said main body, an annular member equipped in the smaller part of said main body, a stepped hollow member having O ring and a bottom portion fixedly inserted within a lower inner wall of said smaller part of said main body, said pressurized fluid induction passage comprises a tube inserted within an inner wall of said intermediate member and connected to said fluid connectors of said plug member of said nozzle body, a tube inserted within a stepped inner wall of said annular member, and embedded into a top portion of said stepped hollow member, said tube within said annular member having a plurality of holes at lower portions thereof and two passages axially provided at a side wall of said stepped hollow member and connected to said holes of said tube within said annular member, said valve means comprises said movable member comprising a needle valve having a conical top portion inserted within an inner side wall of said stepped hollow member, said hollow plunger connected to said needle valve by said tube having holes, coil means for pressing said hollow plunger inserted within said stepped inner wall of said intermediate member, and magnetic coil connected to said electric connector of said plug member fixedly inserted between an inner wall of said large part of said main body and a lower outer wall of said intermediate member, said swirl chamber is formed by said conical top portion of said needle valve and a tapered bottom surface of said bottom portion of said stepped hollow member, each of said two tangential pressurized fluid supply passages if connected to the respective one of said two passages at a right angle and is formed by a hole penetrating from an outer side wall to an inner side wall forming said swirl chamber of said stepped hollow member and a plug member inserted into said hole from said outer side wall to said connecting part of said hole to end said passage, said two tangential pressurized fluid supply passages provided in the plane perpendicular to the axis of said swirl chamber.

14. A swirl injection valve according to claim 13, wherein said nozzle body is provided at the top wall of a surging tank interposed in the intake pipe of a gasoline engine, thereby controlling the fuel injection in response to the electrical signal from the thermo-time switch at the start time of said engine, and said swirl chamber has relations of $di/de \leqq 2$ and $h/de \leqq 0.5$ wherein di is the diameter of the swirl chamber, h is the height of the swirl chamber and de is the diameter of the injection port.

15. A swirl injection valve according to claim 1, wherein said nozzle body comprises a main body composed of a hollow member and a bottom portion, said hollow member having a threaded part at the lower outer side wall thereof, an annular member, a bottomed hollow member having a bottom portion which has a conical groove coaxially formed in an inner bottom surface thereof and stepped inner side wall and a threaded part at outer side wall thereof and an adapter member composed of a hollow member and a bottom portion, said hollow member having two threaded parts respectively at upper inner side wall and lower inner side wall thereof and said bottom portion having a small through hole having a predetermined diameter coaxially to form said injection port, said pressurized fluid supply passage comprises a passage axially formed in a side wall of said main body, a first circular groove coaxially formed at a top surface of said annular member, a passage connected to said first circular groove coaxially formed in a side wall of said annular member, a second circular groove formed at a top surface of said bottomed hollow member and connected to said passage of said annular member, a passage formed in a side wall of said bottomed hollow member and connected to said second circular groove, and two passages axially and symmetrically formed in said bottom portion of said bottomed hollow member and connected to said passage formed in a side wall thereof, said valve means comprises said movable member comprising a needle valve having a stepped conical top portion inserted within an inner side wall of said bottomed hollow member and received by said conical groove of said bottom portion of said bottomed hollow member, a conical push rod inserted within an inner portion defined by side walls of said main body and annular member and connected to said needle valve, a coil spring for pressing said push rod inserted within an inner portion defined by side wall and a wall of said bottom portion of said main body, and a cylindrical hollow chamber defined by a reduced portion of said stepped inner side wall of said bottomed hollow member and said bottom portion thereof and inserted between said passage and said two passages of said bottomed hollow member, said swirl chamber comprises a cylindrical chamber having a predetermined diameter and height, which is formed within said bottom portion of said bottomed hollow member coaxially and at a position below said conical groove of said bottomed hollow member, each of said two tangential pressurized fluid supply passages is connected to the respective one of said two passages of said bottomed hollow member at a right angle and is formed by a hole penetrating from an outer side wall to an inner side wall forming said swirl chamber of said stepped hollow member and a plug member inserted into said hole from said outer side wall to said connecting part of said hole and each of said two passages, said two tangential pressurized fluid supply passages being provided in the plane perpendicular to the axis of said swirl chamber.

16. A swirl injection valve according to claim 15, wherein said nozzle body is provided at an auxiliary combustion chamber having a spark plug connected to said main combustion chamber in a gasoline engine, and said swirl chamber has relations of $di/de \leqq 2$ and $h/de \leqq 0.5$ wherein di is the diameter of the swirl chamber, h is the height of the swirl chamber and de is the diameter of the injection port.

17. A swirl injection valve according to claim 1, wherein said nozzle body comprises a main body composed of a hollow member having a bottom portion and a threaded part at a lower outer side wall thereof, an annular member, a stepped hollow member having a bottom portion and a hollow adapter member which has two threaded parts at the upper inner side wall and the lower outer side wall thereof respectively and stepped inner wall thereof, said injection port comprises a small hole having a predetermined diameter coaxially provided at said bottom portion of said stepped hollow member of said nozzle body, said pressurized fluid induction passage comprises a passage axially formed in a side wall of said main body, a first circular groove coaxially formed at a top surface of said annular member, two passages connected to said circular groove coaxially formed in a side wall of said annular member, a second circular groove coaxially formed at a top surface of said stepped hollow member and connected to said two passages of said annular member, and two passages axially formed in a side wall of said stepped hollow member and connected to said second circular groove, said valve means comprises said movable member comprising a needle valve having a conical top portion inserted within an inner side wall of said stepped hollow member, a conical push rod inserted within an inner portion defined by side walls of said main body and annular member and connected to said needle valve, and a coil spring for pressing said push rod inserted within an inner portion defined by side wall and a wall of said bottom portion of said main body, said swirl chamber is formed by said conical top portion of said needle valve and a tapered bottom surface of said bottom portion of said stepped hollow member, so that said chamber is completely occupied by said needle valve when said needle valve is seated on said tapered bottom surface of said stepped hollow member, each of said two tangential pressurized fluid supply passages is connected to the respective one of said two passages at a right angle and formed by a hole penetrating from an outer side wall to an inner side wall forming said swirl chamber of said stepped hollow member and a plug member inserted into said hole from said outer side wall to said connecting part of said hole and each of said passages, said two tangential pressurized fluid supply passages being provided in the plane perpendicular to the axis of said swirl chamber.

18. A swirl injection valve according to claim 1, wherein said nozzle body comprises a main body composed of a hollow member having a bottomed portion and a threaded part at a lower outer side wall thereof, an annular member, a stepped hollow member having a bottom portion and a hollow adapter member which has two threaded parts at upper inner side wall and lower outer side wall thereof respectively and stepped inner wall, said injection part comprises a small hole having a predetermined diameter coaxially provided at said bottom portion of said stepped hollow member of said nozzle body, said pressurized fluid induction passage comprises a passage axially formed in a side wall of said main body, a first circular groove coaxially formed at a top surface of said annular member, two passages connecting to said circular groove coaxially formed in a side wall of said annular member, a second circular groove coaxially formed at a top surface of said stepped hollow member and connected to said two passages of said annular member, and two passages axially formed in a side wall of said stepped hollow member and connected to said second circular groove, said valve means comprises said movable member comprising a needle valve having a conical top portion inserted within an inner side wall of said stepped hollow member, a conical push rod inserted within an inner portion defined by side walls of said main body and annular member and connected to said needle valve, and a coil spring for pressing said push rod inserted within an inner portion defined by said wall and a wall of said bottom portion of said main body, said swirl chamber is coaxially formed within the nozzle body by an outer wall of said conical top portion of said needle valve and an enlarged inner circular wall having a large diameter of said stepped hollow member and located above said conical top portion of said needle valve, each of said two tangential pressurized fluid supply passages is connected to the respective one of said passages at an angle larger than a right angle and formed by a hole penetrated from an outer side wall to an inner side wall forming said swirl chamber of said stepped hollow member and a plug member inserted into said hole from said outer side wall to said connecting part of said hole and each of said passages, said two tangential pressurized fluid supply passages being provided with the axis of its opening inclined with respect to the axis of said swirl chamber.

19. A swirl injection valve comprising a nozzle body, an injection port on said nozzle body, valve means for opening and closing said port, first fluid passage means within said body communicable with a fluid supply source, a swirl chamber having a circular cross section located adjacent said port and communicable therewith, and second fluid passage means connecting said first passage means and said chamber, and opening tangentially into said chamber, said injection port, first fluid passage means, swirl chamber and second fluid passage means being formed within said one nozzle body, whereby a swirl flow may be imparted to a fluid within said chamber.

20. A swirl injection valve according to claim 19, wherein said second fluid passage means comprises at least one passage extending transversely of said nozzle body.

21. A swirl injection valve according to claim 19, wherein said second fluid passage means comprises two passages extending transversely of said nozzle body and opening tangentially into said swirl chamber at symmetrically opposite positions with respect to the axis of said chamber.

22. A swirl injection valve according to claim 20, wherein said passage is formed by a bore extending from the outer surface of said nozzle body to said chamber.

23. A swirl injection valve according to claim 20, wherein said chamber is substantially cylindrical in shape, and said passage extends substantially perpendicularly to the axis of said chamber.

* * * * *